US005423361A

United States Patent [19]

Richards

[11] Patent Number: 5,423,361

[45] Date of Patent: Jun. 13, 1995

[54] DEBARKER BIT WITH FIBER CUTTER

[76] Inventor: Bruce A. Richards, P.O. Box 3, West Danby, N.Y. 14896

[21] Appl. No.: 260,076

[22] Filed: Jun. 15, 1994

[51] Int. Cl.[6] ..... B27G 13/00; B27L 1/00

[52] U.S. Cl. ..... 144/341; 83/676; 83/835; 144/208 R; 144/208 G; 144/218; 144/228; 144/241; 407/42; 407/48

[58] Field of Search ..... 83/676, 835; 144/2.7, 144/3 R, 208 R, 208 F, 208 G, 218, 230, 241, 236, 378, 228, 341, 342, 340; 407/40, 42, 48, 113

[56] References Cited

U.S. PATENT DOCUMENTS

| | | | |
|---|---|---|---|
| 692,028 | 1/1902 | Page . | |
| 1,673,265 | 6/1928 | Pangborn | 144/208 R |
| 2,818,094 | 12/1957 | Bowling | 144/236 |
| 2,831,514 | 4/1958 | Avard | 144/208 R |
| 2,929,299 | 3/1960 | Jenkins | 144/134 R |
| 4,209,047 | 6/1980 | Weill . | |
| 4,335,767 | 6/1982 | Reuter | 144/378 |
| 4,653,559 | 3/1987 | Ackerman | 144/241 |
| 4,677,886 | 7/1987 | Neu | 83/676 |
| 4,770,219 | 9/1988 | Blackwell, Jr. | 407/48 |
| 5,145,294 | 9/1992 | Flueckiger . | |
| 5,168,907 | 12/1992 | Herrington et al. | 144/241 |
| 5,201,353 | 4/1995 | Weil | 144/241 |
| 5,236,288 | 8/1993 | Flueckiger . | |

OTHER PUBLICATIONS

Forsest Tool Company, "Carbide tipped debarker wear parts".

*Primary Examiner*—W. Donald Bray
*Attorney, Agent, or Firm*—Barnard, Brown & Michaels

[57] ABSTRACT

A bit with a fiber cutter for a rosser head debarking machine. The bit has a base for mounting the bit onto the rosser head. The striking edge of the bit is connected to the base and comes into contact with bark and removes the bark as the rosser head spins. The bit has at least one replaceable fiber cutter that includes a cutting edge that cuts through the bark or fiber within the bark as the rosser head spins. Preferably, the fiber cutter is disk-shaped and tapered away from the striking edge and cuts through the fiber in the bark in a perpendicular direction to the fiber. The cutter can be connected to the bit by a threaded bolt that is positioned through a hole in the middle of the cutter and into a threaded hole in the bit. The bit can have threaded holes on both sides to allow two cutters to be installed or for the bit to be rotated.

8 Claims, 5 Drawing Sheets

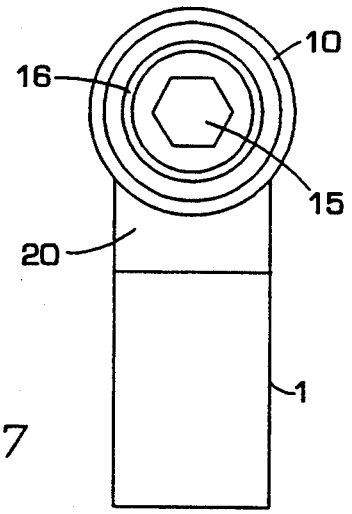
Fig. 7
Fig. 8
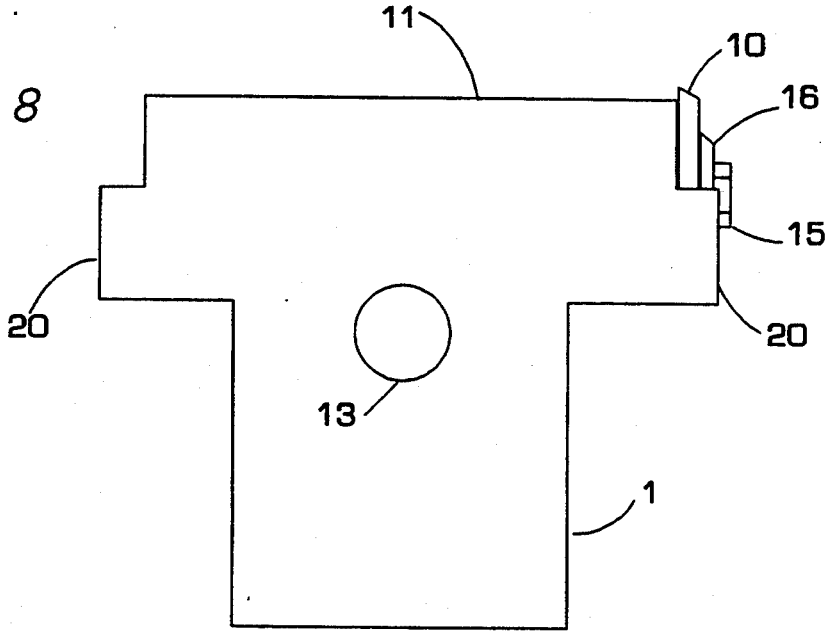

DEBARKER BIT WITH FIBER CUTTER

FIELD OF THE INVENTION

This invention pertains to the field of rotary cutters more specifically to the field of cutters adapted for separating bark from the hardwood of a log.

BACKGROUND OF THE INVENTION

In the field of sawmill operation it is necessary, as one of the steps for preparing a log, the bark of the log is separated from the log. While the technology appears to draw from the field of wood chippers and adzes, it is distinct in that while it is necessary to remove the bark by abrading, it is deleterious to the log to cut significantly into the wood. Thus a cutting head or adz which is equally adapted to chipping wood as well as bark is unsatisfactory for the use.

Two major forms of debarkers are in common use. Typically each depends upon the fact that the shear strength of the bark is weakest in the cambium layer between the wood and the bark.

Once such form of machine is known as the hollow rotor type in which a plurality of arms, swing mounted to a rotary collar extend inward scraping tangentially in a spiral around the exterior of the log which is fed through the center of the collar. Typical such cutters are shown in U.S. Pat. No. 4,231,406 to Jonsson and U.S. Pat. No. 4,709,737 to Jonsson.

A more commonly used form of debarker is the so-called rosser-head debarker in which a log is spun while a rotating cylindrical cutter head passes along and rotates against the log, parallel to the axis of the log. As the log is rotated against the head various forms of cutters upon the rosser-head are depended upon to tangentially shear the bark from the log. Typical such prior constructure shown in the Salem rosser-head debarker and the debarkers manufactured by Fulghum Industries and HMC Corp.

Rosser-head debarkers are all characterized in comprising a substantially strong metal cylinder affixed to a powered rotating axis which is parallel to the longitudinal axis of a log to be debarked with periodically extending cutter teeth on the cylindrical outer surface of the debarker head. The impacts upon these cutter teeth are such that they require frequent resetting or replacement and it is difficult to get even two to three months use from a typical debarker head in full industrial usage.

The rosser-head debarkers have difficulty in efficiently debarking species of wood that have fibrous bark such as basswood. The fibers in the bark do not always get cut by the debarker head and can become tangled and cause the operation to be discontinued until the tangles of fiber can be removed. This makes the process of debarking these types of log very costly and inefficient.

One prior attempt was made to construct a bit that could cut wood fiber while debarking. The bit included wings welded unto each side of the bit and then a built-up alloy edge protruded above the top of the bit. There were two major problems with this bit. First, the protrusions became dull within hours of use and eventually wore down completely within a day or two. There was no way to replace the wings because they were welded to the bits. Even if there was a way to replace the wings the fact that they dulled so quickly would mean that the debarker head would need to be serviced every few hours.

SUMMARY OF THE INVENTION

The applicant has discovered a new type of debarker bit that eliminates the problem of debarking tree species that have fibrous bark.

The present invention teaches a debarker bit with a fiber cutter for a rosser head debarking machine. The bit has a base for mounting the bit onto the rosser head. The striking edge of the bit is connected to the base and comes into contact with bark and removes the bark as the rosser head spins. The bit has at least one replaceable fiber cutter that includes a rounded cutting edge that cuts through the bark or fiber within the bark as the rosser head spins. Preferably, the fiber cutter is disk-shaped and tapered away from the striking edge and cuts through the fiber in the bark in a perpendicular direction to the fiber. The cutter can be connected to the bit by a threaded bolt that is positioned through a hole in the middle of the cutter and into a threaded hole in the bit. The bit can have threaded holes on both sides to allow two cutters to be installed or for the bit to be rotated. The cutter is preferably made from carbide or an equally strong metal or alloy.

The fiber cutter cuts the fibers and prevents tangling and allows the debarking of fibrous barks far more quickly than was previously possible. This relatively simple mechanical improvement to the bit, has had a dramatic improvement on processing speed during debarking and has solved a problem that has perplexed the lumber industry for many years.

The fiber cutter has also been useful in increasing the efficiency of steel bits in debarking any wood species. This means that the steel bits are almost as fast as carbide bits but are not as expensive and do not destroy as much wood fiber.

Other advantages of the apparatus, methods and improvements of the present invention will be apparent from the drawings and following detailed description.

BRIEF DESCRIPTION OF THE DRAWINGS

FIG. 7 is a front view of and another embodiment of a debarker bit with a fiber cutter that includes a shoulder below the cutter.

FIG. 8 is a side view of the embodiment of a debarker bit with a fiber cutter shown in FIG. 7.

DESCRIPTION OF THE PREFERRED EMBODIMENT

Figure 1:
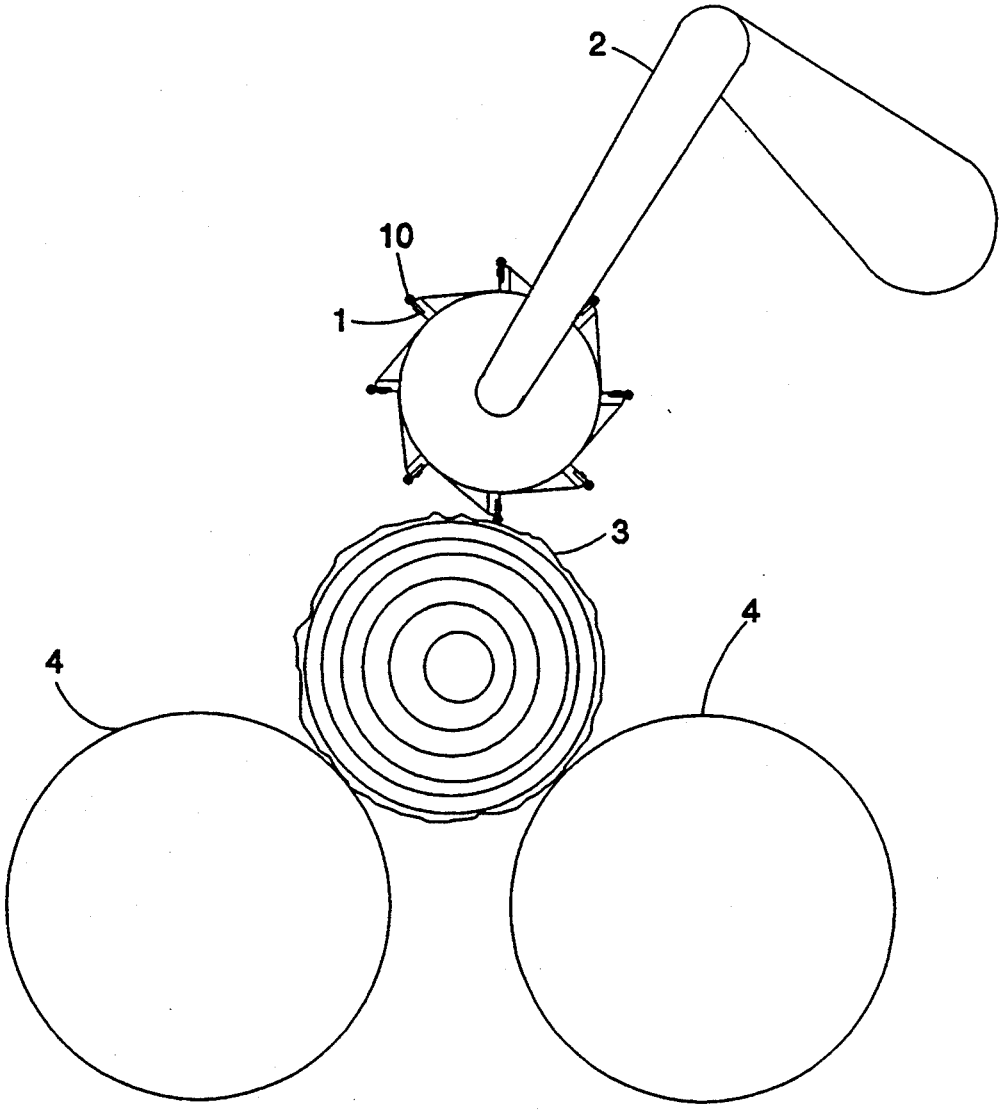
FIG. 1 shows a rosser type debarker fitted with debarker bits with a fiber cutter being used to remove bark from a log.

FIG. 1 shows a rosser type debarker fitted with debarker bits with a fiber cutter being used to remove bark from a log. A rosser type debarker head differs from a swinging arm debarker head principally in that the machine is of the form in which a cylindrical debarker head have a plurality of bits 1 extending axially from its outer surface. It is mounted for rotation upon a rotational axle suspended on a pivoting or swinging arm 2 which may be brought close to or away from or ride upon a log 3 which is supported and spun within a plurality of log support wheels or rollers 4, the debarker head being normally positioned over the log 3, forming a grip on the log 3 between the bits 1 on the debarker head and the log support rollers 4.

The log support rollers 4 are typically angled or textured so as to force the log 3 to, as the log 3 rotates under the debarker head, move laterally so that the entire length of the log 3 passes at a controllable rate or uniform rate under the debarker head as the debarker head rotates. Alternatively, this may be accomplished by providing wheels or pushers to push the log under the debarker head. A typical Rosser Head Debarker uses rollers 4 to revolve the log 3 and mounts the rotary head apparatus on a carriage (not shown) that feeds laterally down the log 3.

Rosser type debarker heads, as with other debarkers, function by chipping away bark. With high speed rotation of the debarker head, the individual bits 1, radiating axially from the cylindrical surface of the debarker head, break into the bark of the log 3. This causes the bark to shear, preferably along the weaker cambium layer which exists in a log between the bark and the wood of the log. Rosser type debarkers are typically used in the lumber industry where it is desired that the wood of the log be maintained in as smooth a condition as possible as the peeled log 3 is to be cut into lumber and the like. Bark chips have no structural strength and thus are not of use for incorporation in composite material but rather are typically sold as landscape ornamentation or used as a feedstock for boilers and power plants within the lumber mill.

When debarking wood species that have fibrous bark, fibers in the bark do not always break and tangle in the machinery. This slows the process down considerably. Many different types of bits and heads have been tried by the present inventor and others in an attempt to solve this problem.

The critical feature of the present invention is the fiber cutter 10 on the side of the debarker bit 1. As the rosser head spins, the fiber cutter 10 cuts the fibers in the bark. Even though the fiber cutter 10 extends past the top of the bit 1, it does not damage to wood fiber. The main portion of the bit 1 still removes the rest of the bark without coming close to the wood fiber. Once the fibers are cut at reasonable intervals, i.e. the length of one bit, the rest of the bit shatters the bark off the log 3.

Referring to FIGS. 3–6, one embodiment of the debarker bit 1 of the present invention is shown. The striking edge of the bit 1 removes the bulk of the bark and is parallel to the length of the log 3. The bit 1 includes at least one fiber cutter 10 that is mounted on the side of the striking portion 11 of the bit such that the edge of the cutter 10 is perpendicular to the striking edge of the bit 1. As the bit 1 strikes the bark, the cutter 10 cuts through any fibers in the bark while the striking edge of the bit 1 removes large portion of bark. The fibers in the bark no longer tangle and the debarking process can be accomplished much faster than was previously possible.

Figure 2:
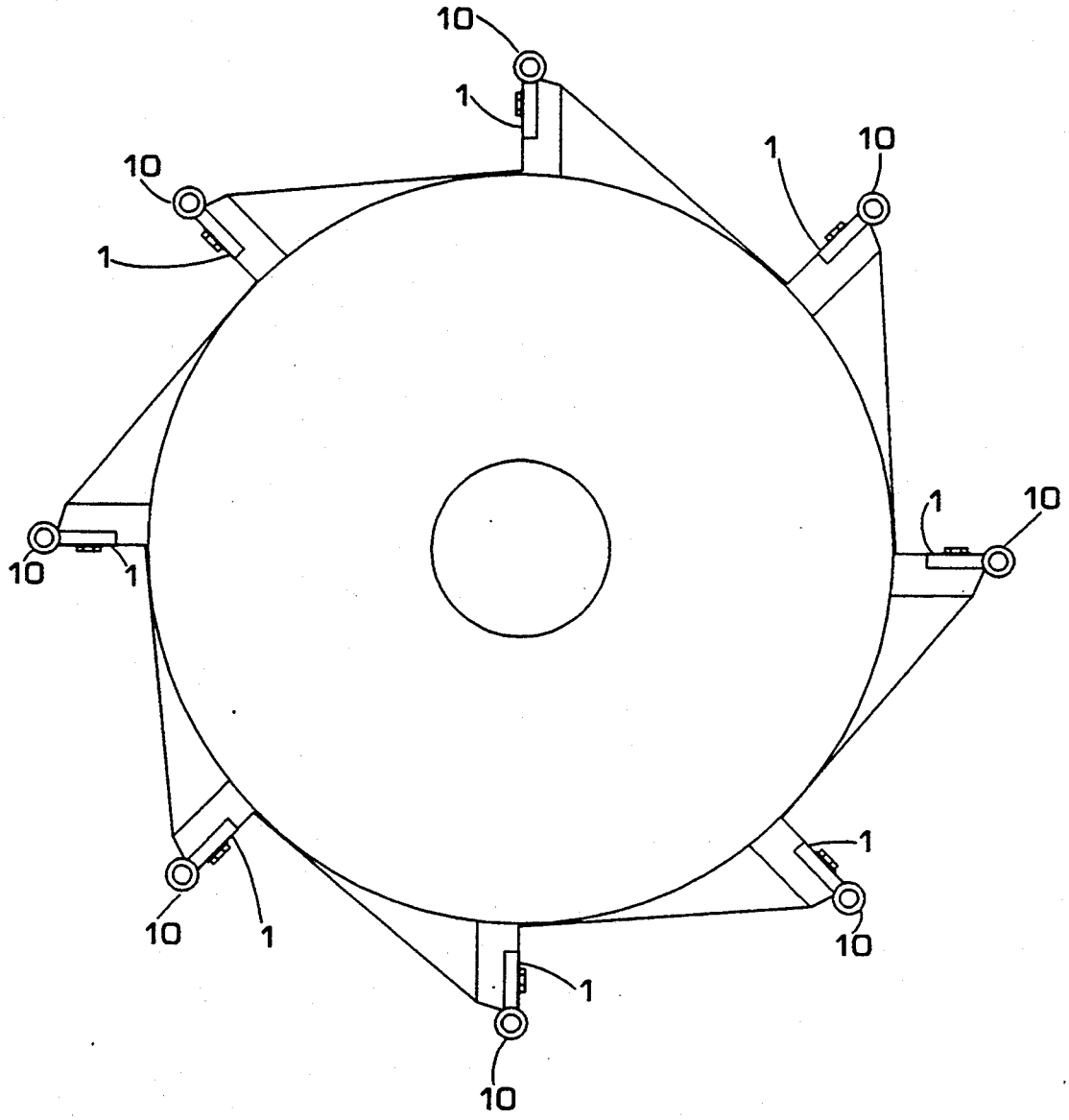
FIG. 2 is a close up view of a cross section of the rosser type debarker head shown in FIG. 1 showing debarker bits with a fiber cutter mounted on the debarker head.
Figure 4:
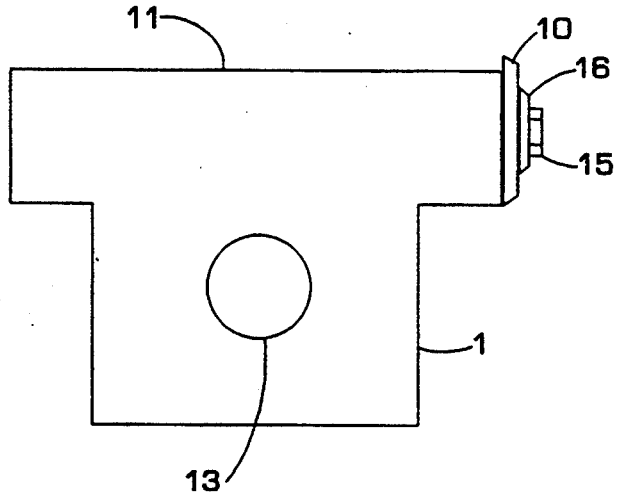
FIG. 4 is a front view of the embodiment of a debarker bit with a fiber cutter shown in FIG. 3.
Figure 3:
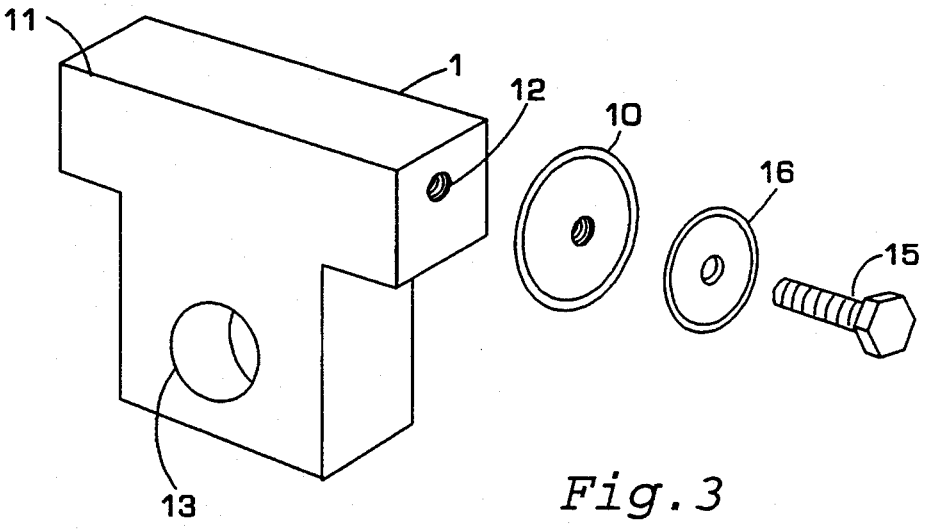
FIG. 3 is a perspective view showing one embodiment of a debarker bit with a fiber cutter.
Figure 5:
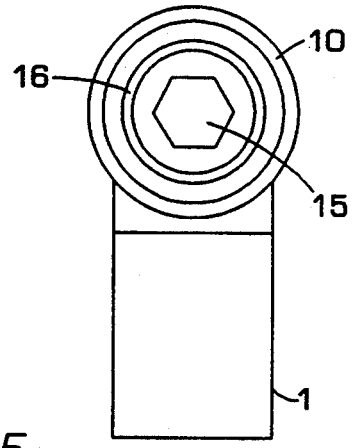
FIG. 5 is a side view of the embodiment of a debarker bit with a fiber cutter shown in FIG. 3.
Figure 6:
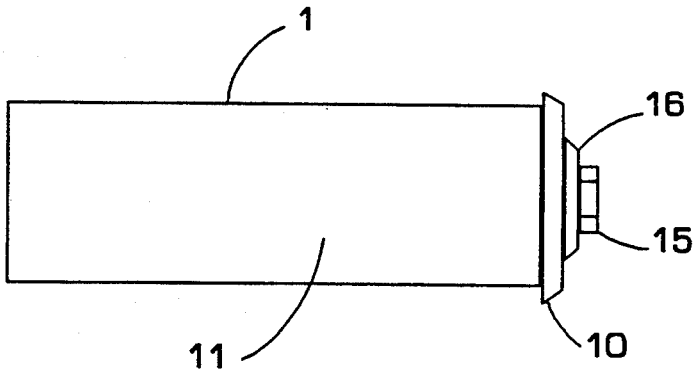
FIG. 6 is a top view of the embodiment of a debarker bit with a fiber cutter shown in FIG. 3.

As shown in FIGS. 3–6, each bit 1 has a hole 13 for fastening the bit 1 to the head of the debarker. The bits 1 are typically attached with a bolt. Such means are well understood to those in the toolmaker's art, and typically are in the form of a central receiving threaded aperture in the rosser head which receives a stud or screw for fastening the bit 1. FIG. 2 show a cross section of the rosser head with the bits 1 attached.

As shown, the cutter 10 is a disk with a sharpened edge. The disk type cutter 10 could be rotated if one portion of the edge became dull. The disk type cutter 10 is currently considered the best mode of cutter 10, however, other shapes of cutters 10 could be used. For example, the cutter could be rectangular with rounded edges to provide a uniform cut into the bark. A rectangular cutter would receive a great amount of stress from the side and could possible break in the middle around the hole 14 for attachment. The circular cutter 10 is uniform around the hole 14.

The cutter 10 is held in position by a threaded bolt 15 that fits goes through a washer 16, the hole 14 in the cutter 10 and into a threaded hole 17 in the bit. The edges of the cutter 10 extend beyond the top and sides of the bit 1. Both the washer and the cutter are angled slightly to cut through the bark more easily and to keep from catching on the bark as it is being removed. A second threaded hole 17 is provided on the other side of the bit 1. This allows two cutters to be placed on the bit 1 if desired, or the bit 1 could be rotated after wearing down on one side. The series of bits 1 along the axis of the rosser head usually overlap a little, so using two cutters 1 on the bits 1 is not generally not needed.

FIGS. 7 and 8 show a bit 1 with a shoulder 20. The shoulder has not been found necessary, but may be helpful in preventing the bolt 15 from sheering off by supporting the cutter 10.

The active part, or the wear part, of the rosser head is the bit 1. The bit 1 is preferably made of a strong metal. The bits 1 shown in the drawings widen slightly at the top. Once attached to the rosser head, the bits 1 overlap slightly. The bits can be made in a variety of ways, but generally are steel or carbide. The cutters 10 are preferably made of carbide.

The carbide bits are considered more "aggressive" in that they remove material faster, but sometimes can start to remove wood fiber as well as bark. The steel bits will wear over time and the striking edge will even become slightly rounded. Prior to the present invention, the steel bits could not remove bark as fast as the carbide bits. However, with the addition of the fiber cutter, the steel bits can remove bark about as fast as the carbide bits even on less fibrous bark. Therefore, the applicant has discovered that the utility of the fiber cutter expands beyond species of trees with fibrous barks. The bits of the present invention can be used to increase the speed of debarking using steel bits. This way the speed of carbide bits can be achieved without the loss of valuable wood fiber.

It may be appreciated that extreme forces are imposed upon a o rosser head debarker during the process of debarking, and the resulting wear is very heavy. In prior debarkers, the debarker head must be taken out of service and the bits 1 replaced and resharpened frequently. The cutters 10 can be replaced while the bits 1 are still on the head and seem to improve the wear on the bits 1.

It can thus be seen that the debarker bit 1 with a fiber cutter 10 discovered by the applicant represents a considerable improvement over the prior art. It is preferred that the rosser head debarker bit of the invention use round cutters, although it can be seen that many advantages of the head would occur with other shapes of cutters as well so long as the cutting edge is rounded and replaceable. Further, the exact form of the bits, the rosser head and the cutters can include many variations in detail, so long as the cutters perform the function of cutting through the bark for fibers in the bark.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

I claim:

1. A bit with a fiber cutter for a rosser head debarking machine, comprising:

a) a base for mounting said bit onto said rosser head;

b) a striking edge connected to said base that comes into contact with bark and removes said bark as said resset head spins; and c) at least one replaceable fiber cutter connected to said bit that includes a rounded cutting edge that cuts through said bark or fiber within said bark as said resset head spins in a perpendicular direction to said fiber.

2. The bit of claim 1 wherein said fiber cutter is disk-shaped and tapered away from said striking edge.

3. The bit of claim 1 wherein said cutter is connected to said bit by a threaded bolt that is positioned through a hole in the middle of said cutter and into a threaded hole in said bit.

4. The bit of claim 3 wherein said bit has a threaded hole on both sides of the bit to secure a cutter by means of a threaded bolt.

5. The bit of claim 1 wherein said fiber cutter is made of carbide.

6. A method of debarking wood with a rosser head debarker comprising the step providing at least one replaceable fiber cutter on said rosser head that includes a rounded cutting edge that engages said bark and cuts any fibrous portion of said bark in a perpendicular direction to said fiber.

7. The method of claim 6 wherein said fiber cutter is disk-shaped.

8. The method of claim 6 wherein said fiber cutter cuts through said fiber in said bark in a perpendicular direction to said fiber.

* * * * *